US012280931B1

(12) United States Patent
Lucero

(10) Patent No.: US 12,280,931 B1
(45) Date of Patent: Apr. 22, 2025

(54) PALLET RETROFIT AND WRAPPING SYSTEM AND RELATED METHODS

(71) Applicant: Greg Lucero, Stockton, CA (US)

(72) Inventor: Greg Lucero, Stockton, CA (US)

( * ) Notice: Subject to any disclaimer, the term of this patent is extended or adjusted under 35 U.S.C. 154(b) by 0 days.

(21) Appl. No.: 18/819,666

(22) Filed: Aug. 29, 2024

(51) Int. Cl.
*B65D 19/00* (2006.01)
*B65B 11/58* (2006.01)
*B65B 13/02* (2006.01)
*B65D 71/00* (2006.01)

(52) U.S. Cl.
CPC ..... *B65D 71/0096* (2013.01); *B65B 11/585* (2013.01); *B65B 13/02* (2013.01); *B65D 2571/00111* (2013.01)

(58) Field of Classification Search
CPC .... B65D 19/00; B65D 19/38; B65D 71/0096; B65D 2571/00111; B65B 11/585; B65B 13/02
USPC ..... 206/386, 597, 600; 108/50.11, 55.1, 108/55.5; 410/97, 100, 103, 105
See application file for complete search history.

(56) References Cited

U.S. PATENT DOCUMENTS 4,738,371 A 4/1988 Wakeman
4,796,392 A 1/1989 Graham, Jr.
5,226,544 A 7/1993 Gallucci et al.
5,423,428 A * 6/1995 Selz ..... B60P 7/0869 206/386
5,762,455 A * 6/1998 Long ..... B60P 7/0823 410/97
6,135,031 A 10/2000 Heil
6,216,607 B1 * 4/2001 Cuddy ..... B65D 71/0096 108/55.5
6,821,068 B2 * 11/2004 Facey ..... B60P 7/0838 410/100
7,311,484 B2 * 12/2007 Facey ..... B65D 71/0096 410/100
7,934,894 B1 5/2011 Temple
8,505,469 B2 * 8/2013 Liu ..... B65D 19/38 108/50.11
9,162,805 B1 10/2015 Testa et al.
10,479,583 B1 11/2019 Werny
10,654,615 B2 5/2020 Storteboom et al.
(Continued)

FOREIGN PATENT DOCUMENTS

WO 2021001843 A1 1/2021

*Primary Examiner* — Luan K Bui
(74) *Attorney, Agent, or Firm* — Sierra IP Law, PC; William K. Nelson

(57) ABSTRACT

A retrofit system optimized to enhance the securement of goods onto a pallet is provided. The system may comprise a plurality of blocks symmetrically positioned around the perimeter of the pallet, each block having a securing plate with a centered anchor. A two-piece strap, operably connected by a ratcheting mechanism, is used to secure goods on the pallet by engaging cable fasteners attached to the straps with the anchors on the blocks. The system also includes a net secured to the straps, providing additional protection and stability by distributing pressure evenly across the goods. The method of incorporating the retrofit system involves fastening the blocks to the pallet using various fastening mechanisms and aligning the blocks with the pallet's edges. The system's straps are constructed from durable, flexible materials resistant to tearing and abrasion, ensuring reliable securement under diverse transportation conditions.

20 Claims, 8 Drawing Sheets

(56) References Cited

U.S. PATENT DOCUMENTS

| | | | |
|---|---|---|---|
| 10,723,510 | B2 | 7/2020 | Chan et al. |
| 10,787,291 | B2 | 9/2020 | Steward et al. |
| 11,174,084 | B2 | 11/2021 | Wang |
| 2007/0289682 | A1 | 10/2007 | Young |
| 2010/0229764 | A1 | 9/2010 | Ingham |
| 2016/0001922 | A1 | 1/2016 | Sadykov |

* cited by examiner

DETAIL A
SCALE 1 : 10

DETAIL A
SCALE 1 : 10

PALLET RETROFIT AND WRAPPING SYSTEM AND RELATED METHODS

FIELD OF THE INVENTION

The present invention relates generally to systems and methods for securing goods during transportation and storage. More specifically, it pertains to a retrofit system for conventional pallets, incorporating adjustable strapping mechanisms and complementary components to enhance load stability and protection. The invention addresses the need for improved securing solutions for pallets used in various industries, including logistics, warehousing, and shipping, offering adaptable and efficient methods for maintaining the integrity of goods throughout the supply chain.

BACKGROUND OF THE INVENTION

The present invention relates to methods and systems for securing goods on pallets to ensure stability and protection during transportation and storage. Ensuring that goods remain intact and undamaged during transit is essential for maintaining product quality and customer satisfaction. One widely used method for securing goods on pallets is pallet wrapping, also known as stretch wrapping, which involves enveloping the goods with a stretch film to stabilize and protect them. Pallet wrapping can be conducted manually or with automated machinery, depending on the scale and requirements of the operation.

In addition to pallet wrapping, several other methods are employed to secure goods on pallets. Strapping involves using metal or plastic straps tensioned and sealed with a tool or machine, suitable for heavy loads. Ratchet straps use a ratcheting mechanism for excellent load stability, ideal for heavy or bulky items. Bungee cords provide a flexible and adjustable means of securing lighter loads quickly. Netting and mesh cover and secure goods, offering versatility for various load shapes, while adhesive and non-slip pads increase friction and stability, and corner boards and edge protectors distribute tension and prevent damage.

Specialized pallets with integrated strapping technology have also been developed to enhance load security. These pallets are designed with built-in straps that can be easily adjusted and tensioned, providing a secure hold on the goods without the need for additional wrapping or external strapping tools. The integrated strapping system simplifies the securing process, reduces handling time, and ensures consistent tension across the load. This innovative solution is particularly beneficial for industries requiring quick and reliable palletization, offering a streamlined approach to load stabilization and protection.

Despite the advantages of specialized pallets with integrated strapping technology, several issues limit their widespread adoption. These include higher initial costs, the need for regular maintenance and potential repairs, limited flexibility for various load types, compatibility issues with existing material handling equipment, increased pallet weight impacting transportation costs and handling efficiency, complexities in recycling and disposal due to the mix of materials used, and additional training requirements for effective and safe use. Addressing these challenges, the present invention aims to provide an improved solution for securing goods on pallets, enhancing load stability and protection while mitigating the drawbacks of current technologies.

SUMMARY OF THE INVENTION

The present invention provides a pallet retrofit system and method that is operable to improve a pallet with a pallet wrapping system that is operable to secure goods. The system may enhance the stability and protection of loads (e.g., goods, boxes, parcels, etc.) during transportation and storage by incorporating a series of strategically positioned blocks and adjustable straps. The blocks may be mounted on the pallet to form a stable structure for attaching a plurality of straps, which apply a uniform tension across the load. The retrofit system of the present invention is operable to transform a standard pallet into a secure transport platform, reducing the risk of damage to goods while maintaining ease of use and adaptability.

In some embodiments, the system may include a plurality of blocks, each featuring a substantially rectangular body with a cutout that may include a securing plate and centered anchor. These blocks are strategically positioned around the perimeter of the pallet, adjacent to its vertical support columns, to provide optimal balance and strength, and to allow the forks of a forklift to engage with a top deck of the pallet when in transport. In such implementations, the blocks allow for the distribution of pressure across the entire load, preventing individual items from shifting during transit. The blocks may be secured to the pallet using various fastening methods, such as bolts, screws, adhesives, clamps, or brackets, depending on the material and design of the pallet.

In some embodiments, pallets may be constructed from various materials, and the blocks may be constructed of a complementary material to ensure optimal performance and compatibility. For example, and not limiting the invention, for a wood pallet, blocks may be constructed from hardwood or plywood, which can be securely attached using screws or nails, providing a strong and durable connection. For plastic pallets made from materials such as high-density polyethylene (HDPE), blocks may also be made from similar plastics, and can be fastened using self-tapping screws or plastic welding techniques to ensure a robust bond. For metal pallets, such as those made from aluminum or steel, blocks constructed from the same metals are ideal and can be secured with bolts or rivets for high-strength attachment. In applications where mixed materials are used, adhesives such as epoxy or construction-grade glue may provide additional security, especially when drilling into the pallet is not feasible. Clamps or brackets may also be employed for quick installation and removal, offering flexibility and adaptability for scenarios requiring dynamic loading and unloading.

In some embodiments, the strap may be adjustable and may have two strap pieces connected through a ratcheting mechanism. This mechanism enables precise tensioning of the straps, allowing the user to securely fasten goods to the pallet with ease. The straps are equipped with cable fasteners that engage the anchors on the blocks, ensuring a firm hold on the load. The strap material may be selected for its flexibility and durability, being resistant to tearing and abrasion, thus ensuring the goods remain stable under various transportation conditions.

In some embodiments, the strap system may incorporate a net that provides an additional layer of security. The net may be operable to envelop the goods completely, distributing pressure evenly across the load and minimizing the risk of movement during transit. Made from durable materials like nylon or polyester, the net is reinforced at its edges and corners to withstand the rigors of transport. This feature is particularly useful for securing irregularly shaped or delicate items, offering protection against external impacts, and ensuring the integrity of the palletized load.

In some embodiments, the straps may include alternative securing mechanisms and configurations to accommodate a variety of pallet designs and load requirements. These alternatives may include the use of bungee-style cables with elastic properties for added flexibility, or different types of fasteners and securing plates to suit specific applications. By providing a versatile and adaptable solution, the invention addresses the limitations of existing pallet securing systems, offering enhanced load stability and protection while being easy to implement and cost-effective.

In one aspect, the invention relates to a pallet retrofit system designed to secure goods on a pallet. The system may include a pallet with a top deck, a bottom deck, and a series of vertical support columns that interconnect these decks to maintain structural integrity. A plurality of blocks, each with a substantially rectangular body, may be symmetrically positioned around the perimeter of the pallet. These blocks may have a first side, a second side, a top surface, a bottom surface, and a front surface with a cutout containing an anchor. A strap with two ends may be used, where each end secures a cable fastener that can be removably engaged with the anchor. This strap may extend over goods placed on the pallet, providing tension and stability to the load during transportation and storage. The blocks are symmetrically arranged between the top and bottom decks, adjacent to at least one of the vertical support columns.

In another aspect, each block may be symmetrically positioned and fastened to the top deck using various fasteners or adhesives. Each block may also have a corresponding block on the opposite side of the pallet, forming a block pair. These block pairs can receive cable fasteners attached to the strap, allowing the strap to exert linear and uniform pressure on the goods. The strap may consist of a first strap piece and a second strap piece, each equipped with a cable fastener at one end. A ratcheting mechanism may connect the two strap pieces, allowing incremental tightening to secure the goods to the pallet effectively. The system may also include a net secured to each strap, covering the goods entirely and providing an additional layer of security by distributing pressure evenly across the surface to prevent shifting and damage during transit. The strap may be constructed from a flexible, durable material that resists tearing and abrasion, ensuring reliable securing of goods under various transportation conditions.

In a further aspect, the pallet retrofit system may involve integrating an adjustable strapping system into a pallet. This includes a block with a substantially rectangular body positioned at a corner of the pallet, featuring a top surface, a bottom surface, and at least two sides aligned with the pallet's edges. The block may have a front surface with a cutout containing a securing plate and a centered anchor for engaging a cable fastener. A strap with a first strap piece and a second strap piece, each having a cable fastener at one end, may be incorporated, with a ratcheting mechanism operably connected between the strap pieces to allow incremental tightening. The system may include fastening mechanisms like bolts, screws, adhesives, clamps, or brackets to secure the block between the top and bottom decks adjacent to at least one vertical support column. A net secured to the straps may cover the goods entirely, providing additional security and distributing pressure evenly.

In yet another aspect, the invention provides a method for incorporating a retrofit system into a pallet and securing goods. This involves providing a pallet with a top deck, a bottom deck, and vertical support columns. A plurality of blocks, each with a rectangular body and a front surface having a cutout with a securing plate and a centered anchor, may be symmetrically positioned around the pallet's perimeter. The blocks may be secured to the pallet using a fastening mechanism, ensuring they are fixed between the decks. Goods are placed on the pallet, and a strap with a first and second piece, each with a cable fastener, may be attached to anchors on opposite sides of the pallet. Engaging a ratcheting mechanism between the strap pieces allows for incremental tightening and securing of the goods. A net secured to the straps may provide additional protection and distribute pressure evenly across the goods, preventing shifting and damage. Fastening mechanisms may include bolts, screws, adhesives, clamps, or brackets, selected based on the pallet's material. The net may be made from materials like nylon, polyester, or Kevlar, with reinforced edges and corners to enhance durability. Each block may have a corresponding block on the opposite side of the pallet, forming pairs that receive cable fasteners, with the strap applying linear and uniform pressure on the goods. The net may be adjustable to conform to various load sizes and shapes, further enhancing security.

Further aspects and embodiments will be apparent to those having skill in the art from the description and disclosure provided herein.

It is, therefore, an object of the present invention to provide methods for integrating a retrofit system into pallets, allowing for enhanced security and stability of goods during transportation and storage and to eliminate the use of plastic wrapping. The invention aims to improve the load-bearing capabilities of standard pallets by incorporating a series of strategically placed blocks and an adjustable strapping system.

It is also an object of the present invention to provide methods and apparatus for securing goods on a pallet through the use of blocks with integrated anchors and cable fasteners. This system is designed to apply uniform pressure across the goods, preventing movement and potential damage while facilitating easy loading and unloading.

It is also an object of the present invention to provide methods and apparatus for securing goods on a pallet through the use of blocks with integrated anchors and cable fasteners. This system is designed to apply uniform pressure across the goods, preventing movement and potential damage while facilitating easy loading and unloading It is another object of the present invention to offer an additional layer of protection through the use of a net that can cover the goods entirely. The net is designed to distribute pressure evenly across the surface of the load, accommodating various sizes and shapes while being constructed from durable materials to withstand environmental and transportation stresses.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
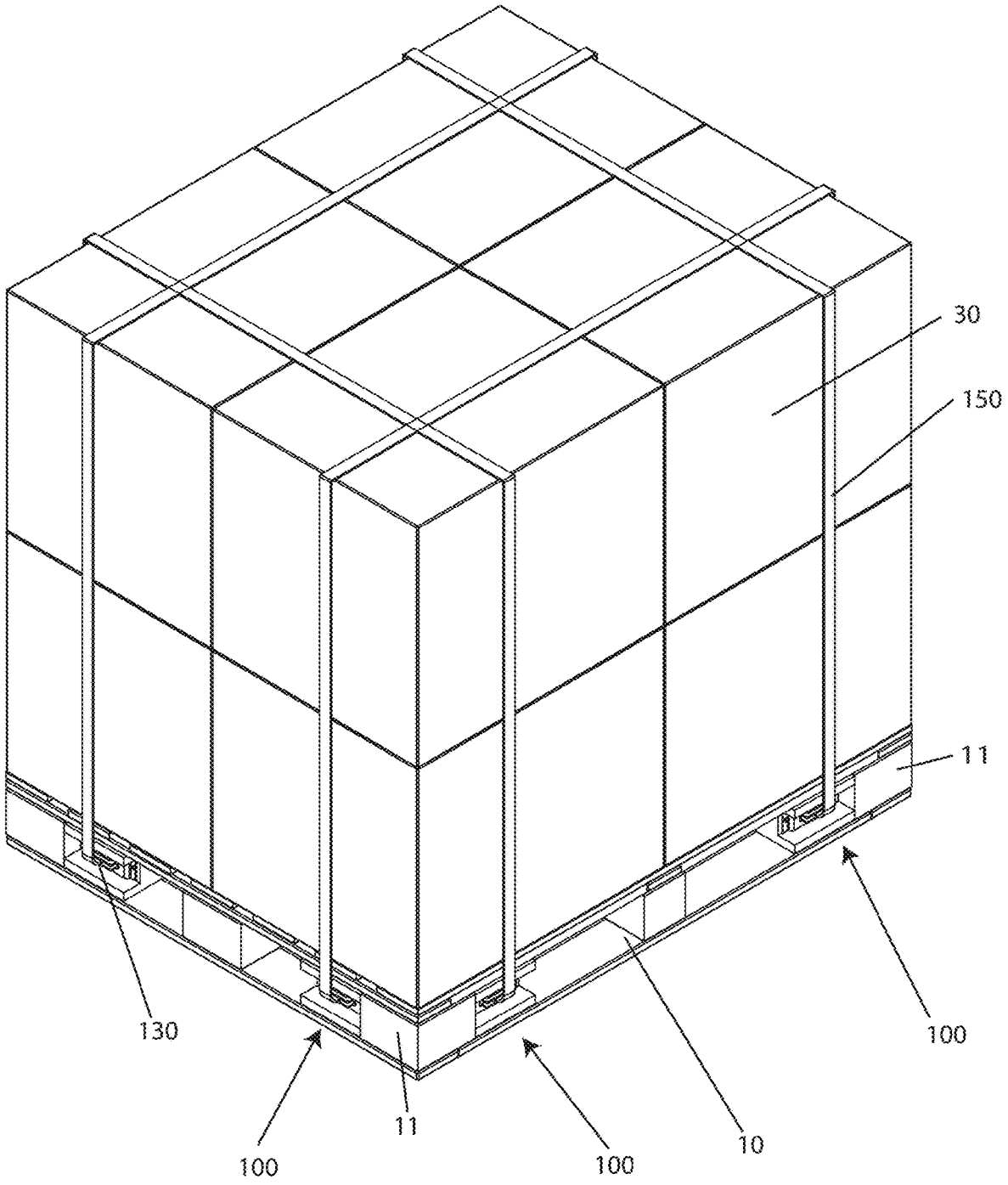
FIG. 1 provides an environmental perspective view of a pallet having a plurality of goods secured with a retrofit pallet wrapping system, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Referring to the drawings, wherein like reference characters designate like or corresponding parts throughout the several views, and referring particularly to FIGS. 1-13, it is seen that the present invention contains various views of a pallet retrofit system that can be integrated into a pallet. The retrofit system includes a plurality of blocks that are operable to receive a cable fastener to allow for secure pallet wrapping with various wrapping devices (e.g., tarps, nets, sleeves, etc.). The block and cables together are operable to adapt a pallet to a specialized pallet with an integrated strapping system that is operable to secure goods to the pallet and ensure stability and protection during transportation and storage.

The present invention includes a pallet wrapping system or a retrofit system 100 that is operable to adapt a pallet 10 into a pallet with an integrated wrapping system, as illustrated in FIG. 1. The retrofit system 100 may include a pair of blocks 110 positioned at opposite ends of the pallet 10. The pair of blocks may each include a receiver 120 and are each operable to receive a cable fastener 130 that are secured to a strap that is operable to secure the goods to the pallet 10.

The illustrated embodiments of the present invention provide a pallet 10 having a standard rectangular shape with a top deck 15 and a bottom deck 14, each deck having an upper surface and a bottom surface. The top and bottom decks (15, 14) are interconnected by a plurality of vertical support columns 11 provided at least at the four corners of the deck and are operable to provide structural integrity. In some embodiments, the top deck 15 may include an array of strategically placed openings and non-slip surfaces to accommodate various load configurations and enhance grip during transport. In some embodiments, the bottom deck is designed with forklift entry points on all sides, allowing easy access to material handling equipment and facilitating efficient loading and unloading operations.

Figure 2:
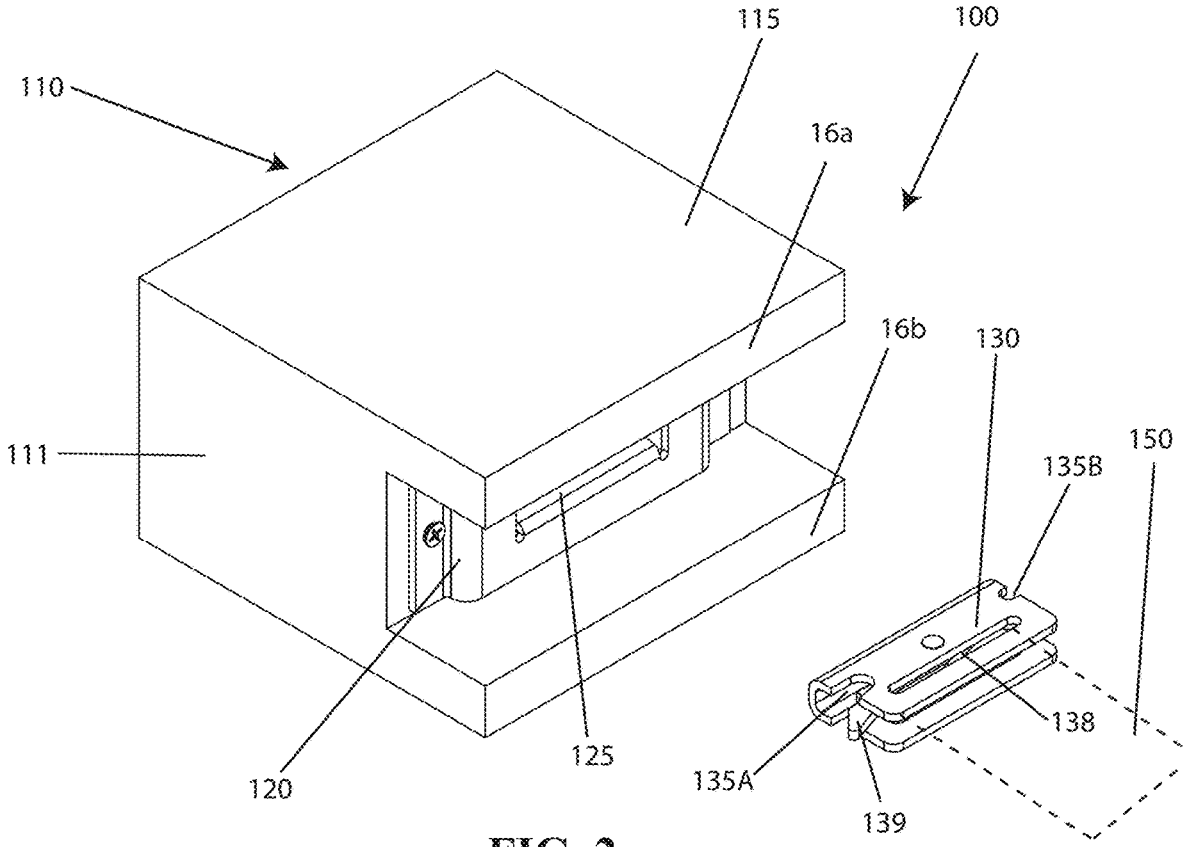
FIG. 2 provides an exploded perspective view of a pallet wrapping block and a cable fastener, according to an embodiment of the present invention.
Figure 3:
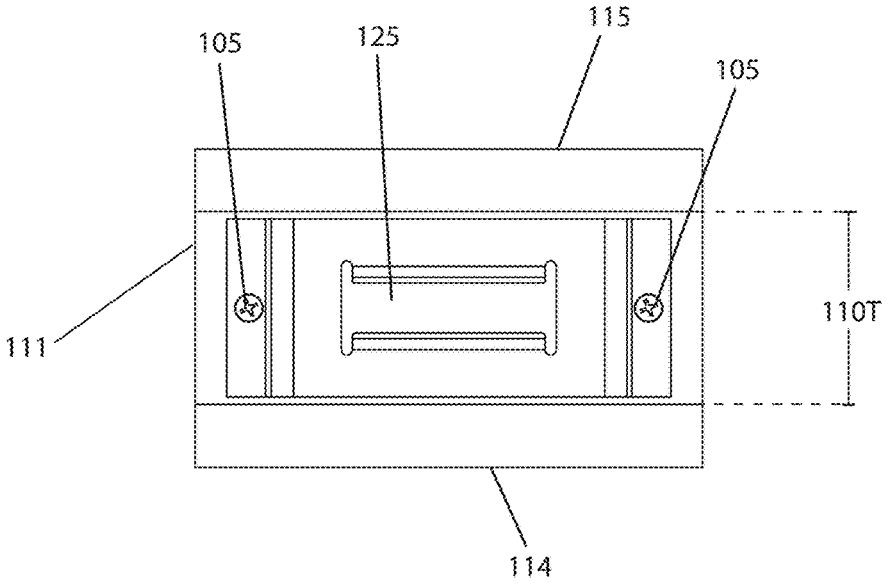
FIG. 3 provides a front view of a pallet wrapping block, according to an embodiment of the present invention.
Figure 4:
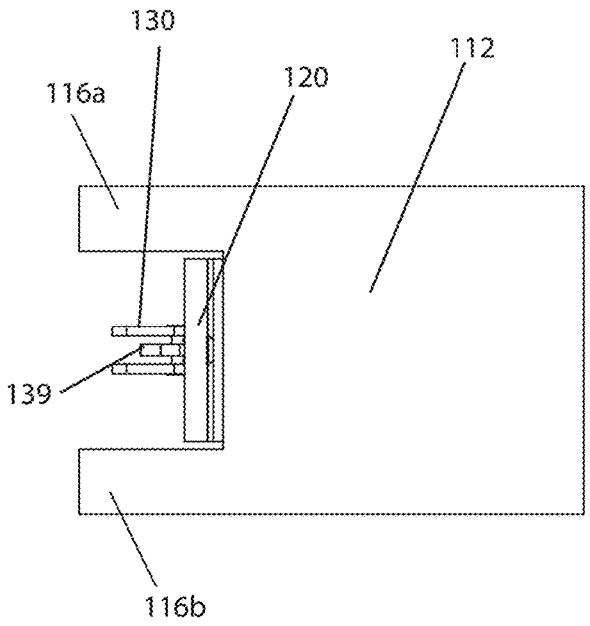
FIG. 4 provides a side view of a pallet wrapping block and cable fastener, according to an embodiment of the present invention.
Figure 5:
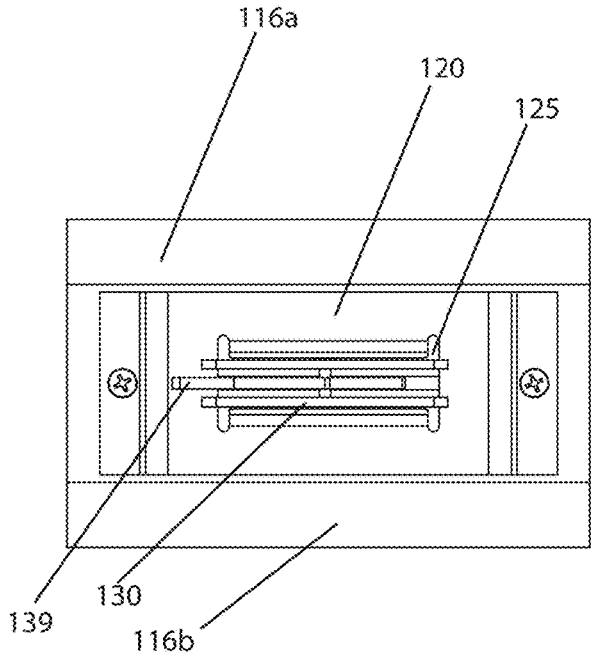
FIG. 5 provides a front view of a pallet wrapping block and cable fastener, according to an embodiment of the present invention.
Figure 11:
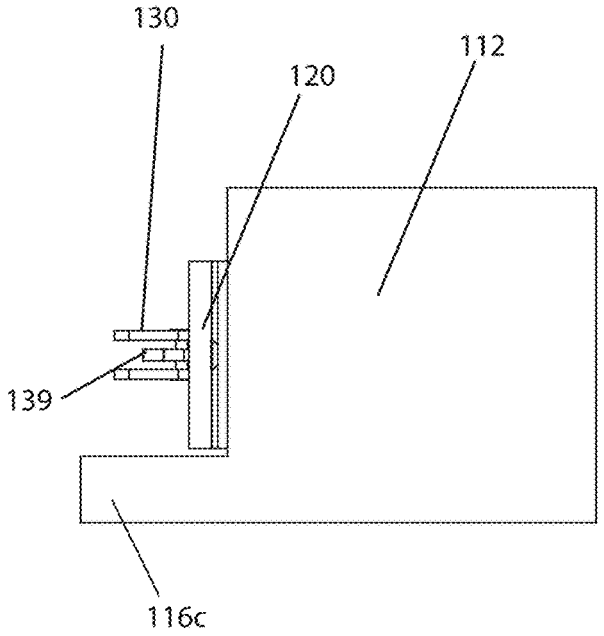
FIG. 11 provides an exemplary side view of a pallet wrapping block and cable fastener, according to an embodiment of the present invention.

As illustrated in FIGS. 2-5, the present invention may include a block 110 having a substantially rectangular body with a first side 111, a second side 112, a top surface 115, and a bottom surface 114. The block 110 may include a front surface 116 with a slot 110T securing a plate 120 having a centered anchor 125, best illustrated in FIGS. 3-5. The centered anchor 125 may be operable to removably secure a cable fastener 130 and a strap 150, as shown in FIGS. 2 and 4-5. The slot 110T may have a top flange **116*a* and a bottom flange 116*b* extending from the top and bottom surface (115, 114). The flanges 116*a* and 116*b* may be operable to assist users in aligning the block with the peripheral edge of the top and bottom decks (15, 14) and are further operable to prevent unintentional disengagement of the cable fastener 130. In some embodiments, as illustrated in FIG. 11 only one flange 116*c* is provided to facilitate alignment with the edge of the pallet 10**.

As best illustrated in FIG. 2, the cable fastener 130 may include a flat slot 138 that is operable to receive a strap 150 (e.g., webbing), and may include a pair of tabs 135A, 135B positioned at opposite ends of the slot 138 and are operable to engage with the centered anchor 125. In some embodiments, the cable fastener 130 may have a spring-loaded lock 139 that is operable to disengagingly secure the cable fastener to the anchor 125.

For illustrative purposes, the securing plate 120 may be an E-track plate that is operable to receive various tie-down systems and anchor points, and the cable fastener 130 may be a webbing guide for an E-track system. However, it is to be appreciated that, in alternative embodiments, the securing plate may be a D-ring anchor plate, an L-track plate, a combination springloaded E-track snap fastener having a rings that is operable to receive hooks or may be a custom-designed securing mechanism that provides similar functionality. Likewise, the cable fastener 130 may be a ratchet buckle, a cam buckle, or any other suitable fastener designed to secure straps or webbing to the securing plate. These alternative configurations allow for the flexible adaptation of the retrofit system to different pallet types and load requirements, thereby providing versatility and utility across a broad range of applications. Additionally, the system may incorporate other fastening technologies, such as magnetic or quick-release mechanisms, and can be adapted for use with materials including but not limited to nylon, polyester, or Kevlar webbing, offering varying degrees of strength and elasticity. Such modifications and variations are within the scope of the present invention, as it will be apparent to persons having ordinary skill in the art that these alternatives can achieve the desired securing functions while adapting to specific operational needs.

Figure 6:
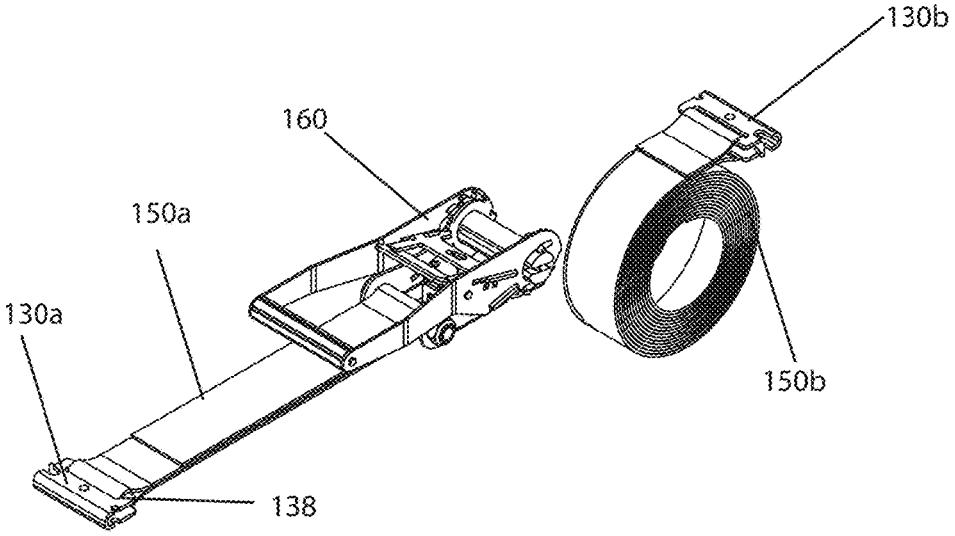
FIG. 6 provides an exemplary perspective view of a cable fastener assembly, according to an embodiment of the present invention.

In some embodiments, as illustrated in FIG. 6, the strap 150 may include a ratcheting mechanism 160 secured to the proximal end of a first strap 150*a* having a first cable fastener 130*a* on the distal end. In such embodiments, a second strap 150*b* may have a proximal end with a second cable fastener 130*b* and a free distal end that is operable to engage with the ratcheting mechanism 160.

As illustrated in FIGS. 7-10, the retrofit system 100 may be incorporated into a pallet 10 by positioning a block 110 between the top and bottom decks (15, 14) and aligning at least one side (111, 112) of block 110 with a structural member 11 and fastening the block to the pallet 10. For each block 110, shown in FIGS. 7 and 10, there is a block positioned at an opposite end of the pallet such that a plurality of blocks are symmetrically positioned about a lateral and longitudinal center of the pallet 10. Although not illustrated, it is to be appreciated that the blocks may be fastened using various fastening methods, for example, bolts, screws, adhesives, welding, or clamps, without limiting the invention. This versatility in fastening options ensures that the retrofit system can be securely attached to a wide range of pallet designs, providing a robust and reliable solution for converting pallets into specialized pallets with an integrated strapping system.

Figure 7:
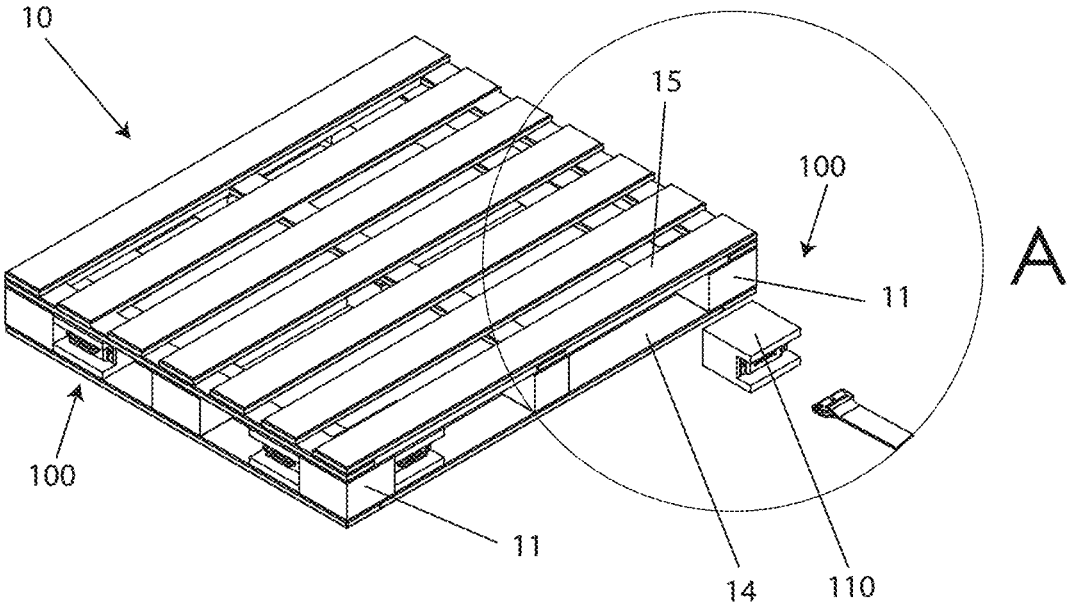
FIG. 7 provides an environmental perspective view of a patent and the steps of securing a pallet wrapping block and cable fastener assembly to the pallet, according to an embodiment of the present invention.
Figure 8:
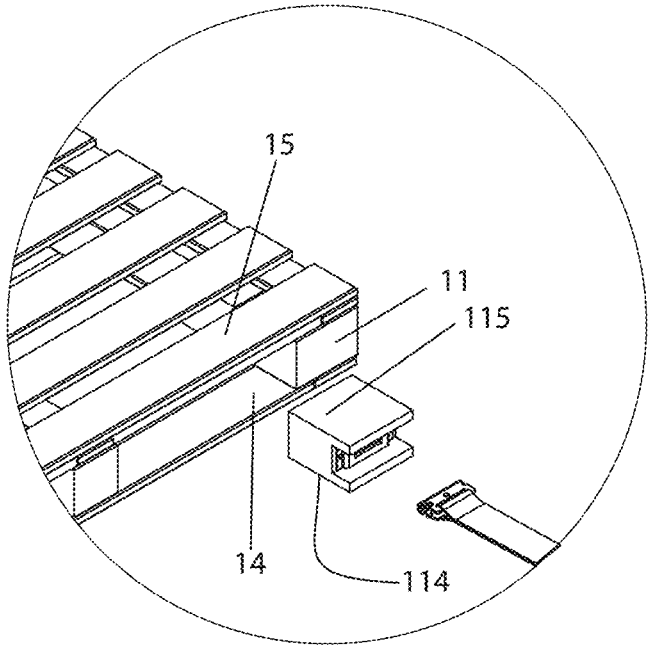
FIG. 8 provides a detailed view of section A of FIG. 7, according to an embodiment of the present invention.
Figure 9:
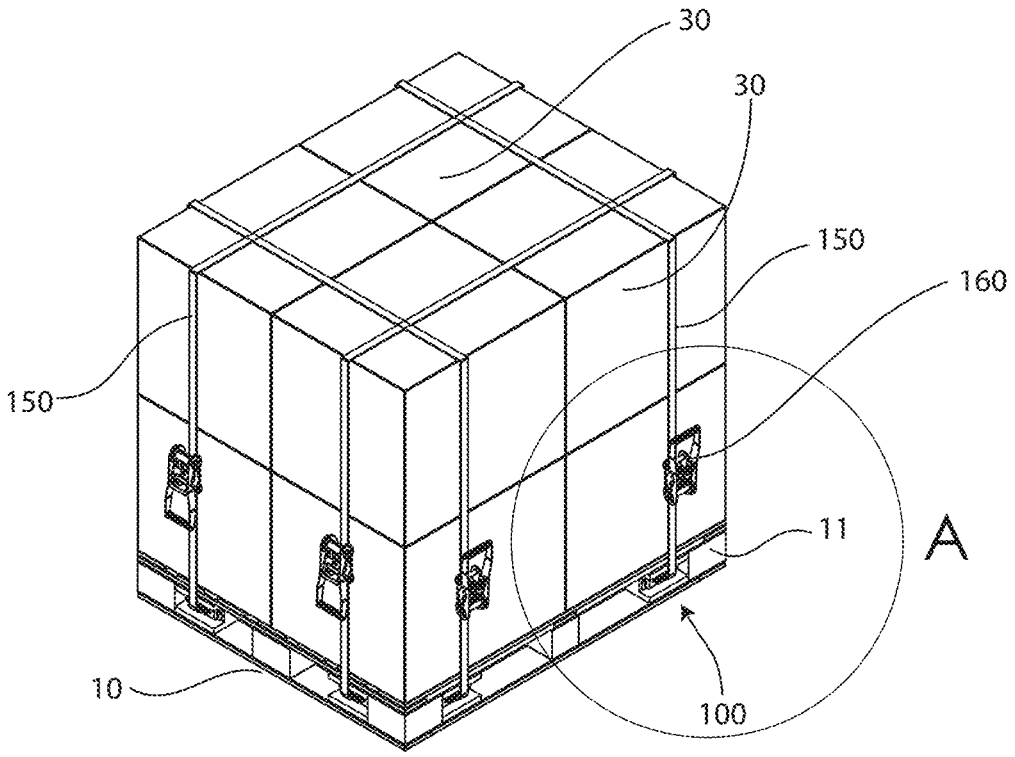
FIG. 9 provides an environmental perspective view of a patent securing a plurality of goods with the pallet wrapping block and cable fastener assembly to the pallet, according to an embodiment of the present invention.
Figure 12:
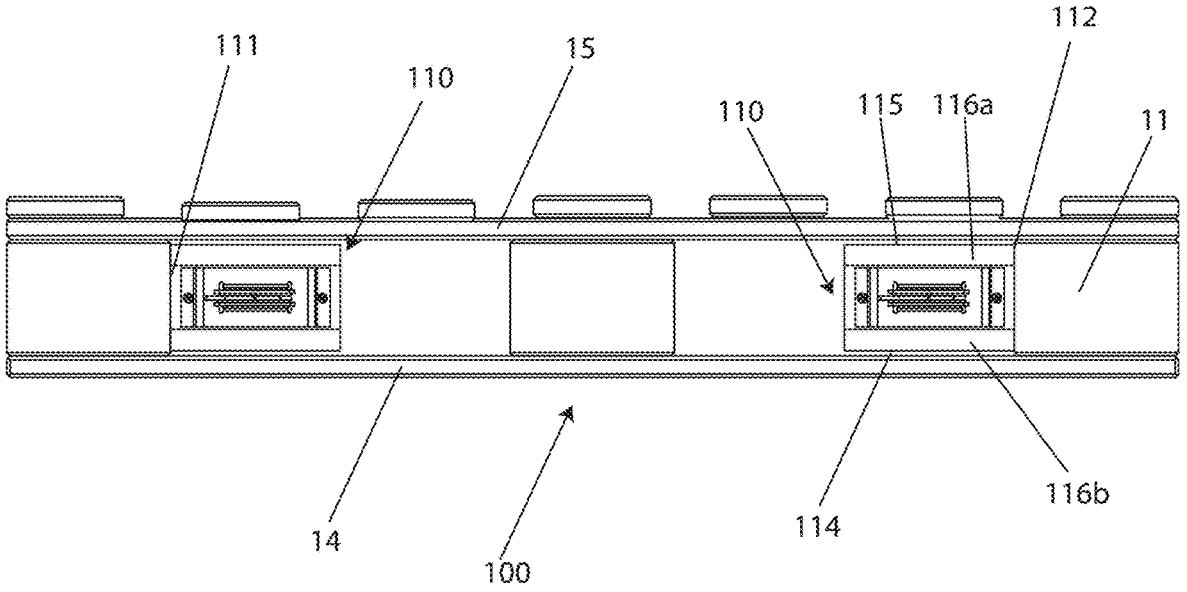
FIG. 12 provides a front view of a pallet equipped with a retrofit pallet wrapping system, according to an embodiment of the present invention.

The present invention provides a plurality of block(s) 110 secured symmetrically around the pallet 10, to simplify the installation process, a single block 110 is described, herein. As illustrated in FIGS. 7 and 12, the block 110 may be securely attached to a corner of a pallet 10. First, a user identifies the desired corner of the pallet 10 where the block 110 will be installed, ensuring that the corner is structurally sound and free of damage to provide a stable foundation for attachment. Aligning the block 110 with a structural member 11 at the corner of the pallet, ensuring that the block's sides (111, 112) are flush with the outer surface of the structural member 11 and the block's front surface 116 facing outward. The block 110 may then be fastened to the pallet using bolts or screws inserted through pre-drilled holes in the block and into the pallet's wood or composite material, ensuring that the fasteners penetrate deeply enough to secure the block without splitting the pallet material.

In some embodiments, heavy-duty adhesives suitable for wood or composite materials may be applied to the bottom surface 114, top surface 115, or a combination of both to bond the block 110 to the pallet 10 corner, allowing sufficient curing time as per the adhesive manufacturer's instructions. In some implementations, clamps or brackets may be used to further secure the block 110 to the pallet by positioning them over the block and anchoring them with screws or bolts (not shown). This combination of fastening methods enhances the robustness of the attachment, particularly for pallets intended to carry heavier loads or those subject to vibration or movement. Once the block 110 is securely attached, the centered anchor 125 is accessible and ready to receive the cable fastener 130, which is pre-attached to the strap 150. The strap 150 is extended across the load, and the ratcheting mechanism 160 is engaged to adjust the tension on the strap 150, thereby securing the load 30 to the pallet effectively. This method provides a simplified yet effective solution for integrating an adjustable strapping system into pallets, allowing for flexibility in securing various load types while maintaining overall stability and protection during transit and storage.

Figure 10:
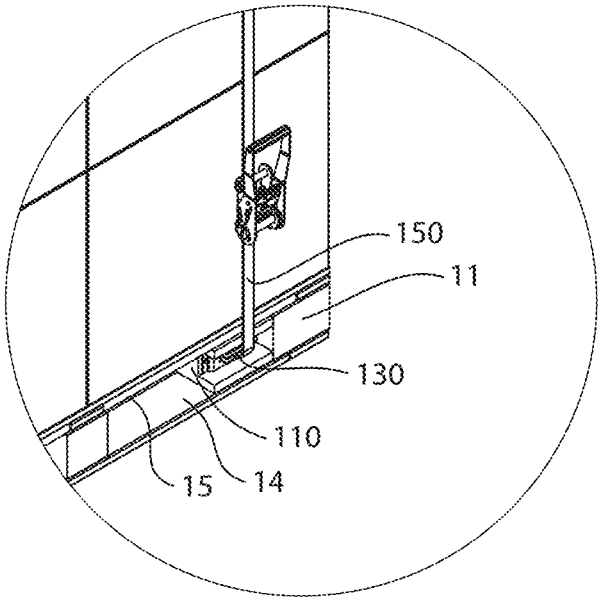
FIG. 10 provides a detailed view of section A of FIG. 10, according to an embodiment of the present invention.

In such embodiments, the cable fasteners 130*a* on the first side of the strap 150*a* may be inserted into a centered anchor 125 of the block 110 on one side of the pallet 10. On the second side of the strap 150*b* a second cable fastener 130*b* may be inserted into the centered anchor 125 of the block 110 on the other side of the pallet 10. To secure a plurality of boxes 30 to the pallet 10, the user begins by extending a plurality of straps 150 over the boxes 30, ensuring that the strap 150 lies flat against the surface of the boxes to prevent shifting during transit. Once the strap 150 is positioned over the load, the user can engage the ratcheting mechanism 160, as illustrated in FIG. 10, to tighten the strap, providing sufficient tension to secure the boxes 30 firmly in place. This process is repeated for each strap, ensuring that all sides of the load are adequately secured. The ratcheting mechanism allows for easy adjustment of the strap tension, ensuring that the goods remain stable and protected throughout transportation and storage. This method of installation provides a straightforward and efficient means of securing various load configurations, adapting easily to different cargo shapes and sizes, and maintaining the integrity of the palletized load.

In some embodiments, as illustrated in FIG. 1, the straps 150 of the pallet wrapping system may be a bungee-style cable and may include elastic properties that allow them to stretch and conform to the contours of the load, providing a snug and secure fit. These bungee-style cables can be equipped with hooks or fasteners at each end that are operable to engage with the blocks 110 and the centered anchors 125, ensuring quick and easy attachment and detachment. The elasticity of the bungee-style cables allows them to absorb shocks and vibrations during transit, offering additional protection to the goods. Furthermore, the flexible nature of the bungee cables makes them adaptable to various load sizes and shapes, enhancing the versatility of the pallet wrapping system in securing a wide range of products.

Figure 13:
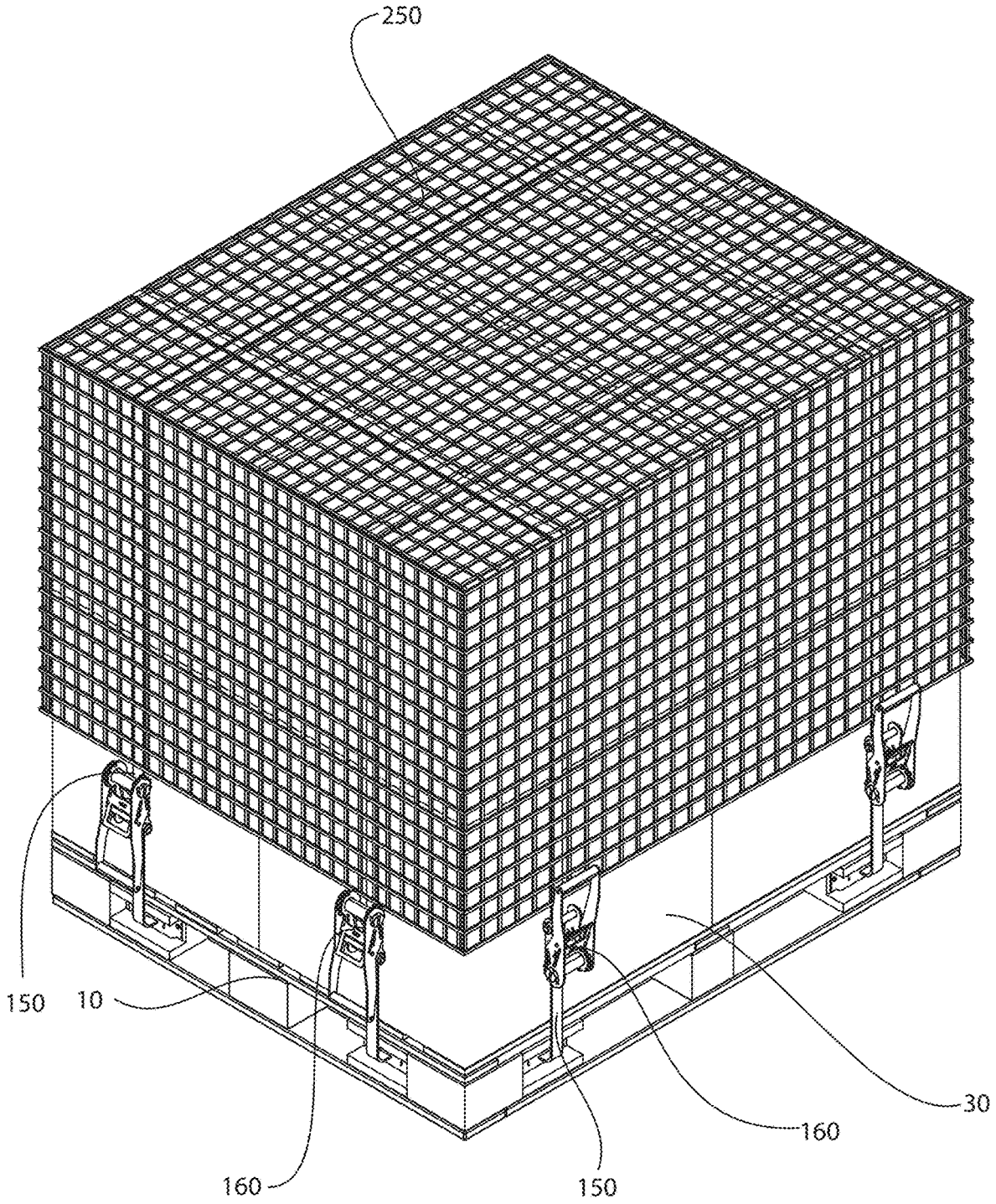
FIG. 13 provides a perspective view of a pallet equipped with a retrofit pallet wrapping system, according to an embodiment of the present invention.

In some embodiments, as illustrated in FIG. 13, the straps 150 of the pallet wrapping system may incorporate a net 250 that is operable to cover the goods and provide an additional layer of security by enveloping the load entirely. The net 250 can be made of durable and flexible materials, such as nylon or polyester, which allow it to conform to various load shapes and sizes. The net is attached to the straps 150 at multiple points, ensuring even distribution of tension across the load, preventing movement or shifting during transit. The mesh structure of the net enables visibility and ventilation, reducing the risk of condensation and damage to the goods. Additionally, the net 250 can be equipped with reinforced edges and corners to enhance its durability and resistance to tearing. This configuration offers a comprehensive solution for securing irregularly shaped or delicate items, providing protection against external impacts and maintaining load integrity throughout transportation and storage.

Figure 14:
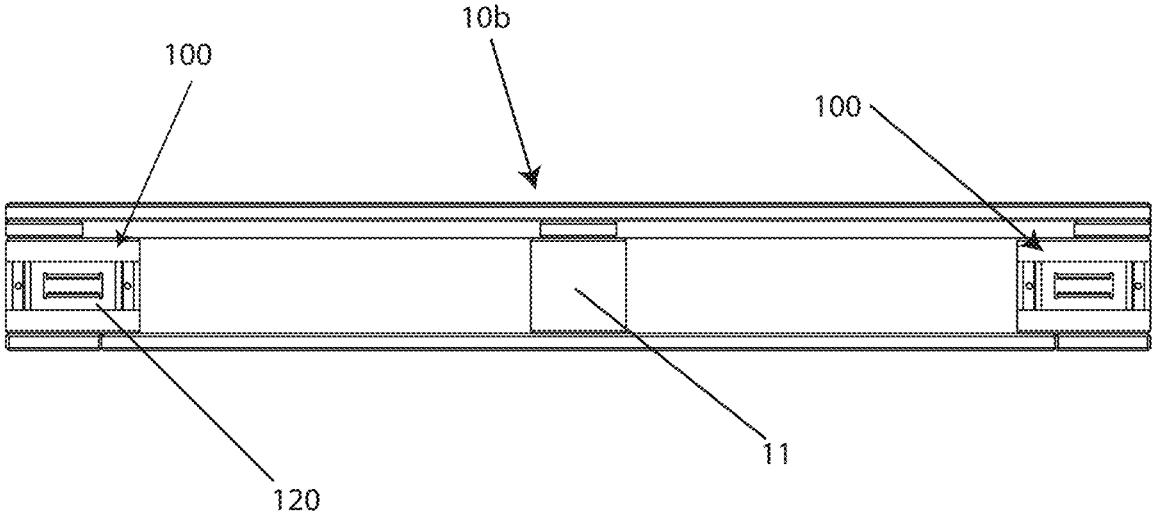
FIG. 14 provides a side view of a pallet adapted with a wrapping block and cable fastener, according to an embodiment of the present invention.
Figure 15:
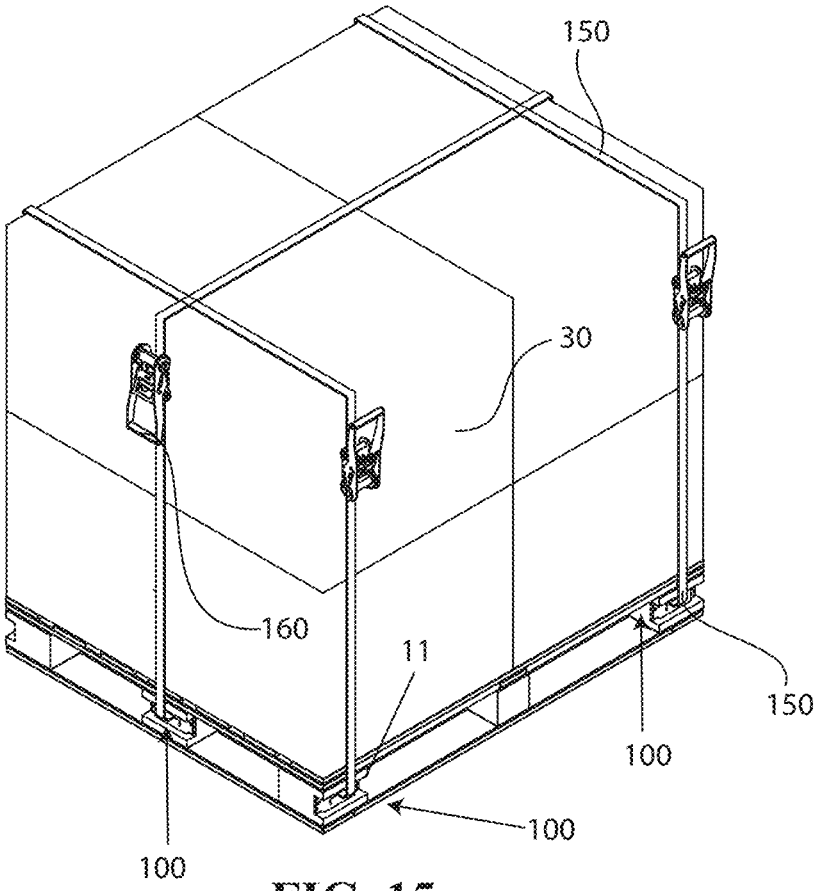
FIG. 15 provides a perspective view of a pallet adapted with a wrapping block and cable fastener, according to an embodiment of the present invention.

In some embodiments, as illustrated in FIGS. 14-15, the pallet wrapping block 100 may be integrated directly into the vertical support columns 11 of the pallet 10*b*, or replace the four corner and central support columns entirely. This integration allows the pallet 10*b* to function as a single, cohesive unit with the wrapping system built into its structure. The blocks 100 may be constructed to replace or complement the traditional support columns 11 by providing both structural integrity and a secure anchor point for the cable fasteners 130. In such embodiments, integrating the blocks 100 into the pallet's framework, the system eliminates the need for additional external fastening mechanisms, streamlining the securing process. The blocks 100 may be strategically positioned at the corners and central areas of the pallet 10*b*, ensuring that the load 30 is evenly supported and securely fastened. The straps 150 are engaged with the cable fasteners 130, and a ratcheting mechanism 160 is employed to adjust the tension, securing the load 30 effectively. This design enhances the overall strength and durability of the pallet 10*b* while simplifying the process of attaching straps 150 and securing goods, making it particularly well-suited for heavy-duty or high-volume applications.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A pallet retrofit system for securing goods on a pallet, comprising:

a. a plurality of blocks, each block having a substantially rectangular body with a first side, a second side, a top surface, a bottom surface, a front surface having a cutout with an anchor therein; and b. a strap having two ends that each secure a cable fastener that is operable to removably engage with said anchor, wherein the strap is extendable over goods positioned on a pallet and is operable to secure the goods to the pallet, thereby providing tension and stability to a load during transportation and storage, said pallet having a top deck, a bottom deck, and a plurality of vertical support columns interconnecting the decks, wherein each block in said plurality of blocks is symmetrically positioned around a perimeter of said pallet between said top deck and said bottom deck, and adjacent to at least one of said vertical support columns.

2. The system of claim 1, wherein each block in said plurality of blocks is symmetrically positioned and fastened to said top deck using a plurality of fasteners or an adhesive.

3. The system of claim 2, wherein each block in said plurality of blocks corresponds to a block on an opposite side of said pallet, forming a block pair.

4. The system of claim 3, wherein each block in said block pair is operable to secure a cable fastener to said anchor on one end of said strap and is operable to apply a linear and uniform pressure on said goods.

5. The system of claim 4, wherein said strap comprises a first strap piece and a second strap piece, each having a cable fastener at one end, and wherein the ratcheting mechanism is operably connected between the first strap piece and the second strap piece, allowing for incremental tightening of the strap pieces, thereby increasing tension and securing the goods to the pallet.

6. The system of claim 5, further comprising a net secured to each of said straps, wherein the net is operable to cover the goods entirely, providing an additional layer of security and protection, and distributing pressure evenly across the surface of the goods to prevent shifting and damage during transit.

7. The system of claim 6, wherein said strap is constructed from a flexible, durable material that is resistant to tearing and abrasion, and includes reinforced edges and corners to enhance durability, thereby ensuring that the net maintains its integrity and continues to provide protection and stability to the goods under various transportation conditions.

8. A pallet retrofitting device for integrating an adjustable strapping system into a pallet, comprising:

a. a block with a substantially rectangular body operable to be positioned at a corner of a pallet, the block having a top surface, a bottom surface, and at least two sides operable to be aligned with the edges of the pallet, the block further comprising a front surface having a cutout with a securing plate positioned within the slot, wherein the pallet has a top deck, a bottom deck, and a plurality of vertical support columns interconnecting the decks;

b. a securing plate positioned on the cutout on the block, the securing plate having a centered anchor configured to removably engage a cable fastener; and c. a strap comprising a first strap portion and a second strap portion, each having a cable fastener at one end, wherein the ratcheting mechanism is operably connected between the first strap portion and the second strap portion, allowing for incremental tightening of the strap portions, thereby increasing tension and securing the goods to the pallet.

9. The system of claim 8, further comprising a fastening means selected from the group consisting of bolts, screws, adhesives, clamps, or brackets to secure the block to the pallet, ensuring that the block is fixed between the top deck and bottom deck, and adjacent to at least one of the vertical support columns.

10. The system of claim 9, further comprising a net secured to each of said strap portions, the net operable to cover the goods entirely, providing an additional layer of security and protection by distributing pressure evenly across the surface of the goods to prevent shifting and damage during transit.

11. The system of claim 8, wherein said cutout on the block may have a substantially U-shaped geometry or a substantially L-shaped geometry.

12. A method for incorporating a retrofit system into a pallet and securing goods thereon, comprising the steps of:

a. providing a pallet having a top deck, a bottom deck, and a plurality of vertical support columns interconnecting the decks to provide structural integrity;

b. providing a plurality of blocks, each having a substantially rectangular body with a front surface having a cutout with a securing plate and a centered anchor therein, and positioning said plurality of blocks symmetrically around a perimeter of said pallet between said top deck and bottom deck, and adjacent to at least one of the vertical support columns;

c. securing each of said blocks to said pallet using a fastening mechanism, ensuring the block is fixed between said top deck and bottom deck;

d. placing a plurality of goods on said top deck of said pallet; and e. attaching a strap comprising a first strap piece and a second strap piece, each having a cable fastener at one end, to the centered anchors of blocks positioned on opposite sides of the pallet, wherein the straps are operable to secure said plurality of goods to said pallet.

13. The method of claim 12, further comprising engaging a ratcheting mechanism operably connected between said first strap piece and said second strap piece to incrementally tighten said strap, thereby increasing tension and securing said goods on said pallet.

14. The method of claim 13, further comprising deploying a net secured to each of said straps over said goods, said net providing an additional layer of security and protection by distributing pressure evenly across the surface of said goods to prevent shifting and damage during transit.

15. The method of claim 14, wherein said fastening mechanism is selected from the group consisting of bolts, screws, adhesives, clamps, or brackets, and is dependent on the material construction of said pallet.

16. The method of claim 15, wherein the step of securing each of said blocks further comprises aligning said block such that at least two sides are flush with pallet edges.

17. The method of claim 16, wherein said strap is made from a flexible, durable material that is resistant to tearing and abrasion, ensuring reliable securing of said goods under various transportation conditions.

18. The method of claim 17, wherein said net is constructed from a material selected from the group consisting of nylon, polyester, or Kevlar, and includes reinforced edges and corners to enhance durability.

19. The method of claim 18, wherein each of said blocks has a corresponding block on an opposite side of said pallet forming a block pair, such that each said block pair is operable to receive one of said cable fasteners on said strap, said strap applying a linear and uniform pressure on said goods.

20. The method of claim 19, wherein said net is operable to cover said goods entirely, and further comprises means for adjusting said net to conform to various load sizes and shapes.

* * * * *